US005927407A

United States Patent [19]

Gwinn et al.

[11] Patent Number: 5,927,407

[45] Date of Patent: Jul. 27, 1999

[54] ISOLATED HAND-HELD VIBRATING DEVICE

[75] Inventors: James T. Gwinn; Robert H. Marjoram, both of Erie, Pa.

[73] Assignee: Lord Corporation, Cary, N.C.

[21] Appl. No.: 09/120,165

[22] Filed: Jul. 21, 1998

Related U.S. Application Data

[63] Continuation of application No. 08/663,155, Jul. 26, 1995, Pat. No. 5,839,517, which is a continuation-in-part of application No. 08/009,695, Jan. 27, 1993, abandoned.

[51] Int. Cl.[6] ..... B25D 17/24

[52] U.S. Cl. ..... 173/162.2; 173/211

[58] Field of Search ..... 173/162.1, 162.2, 173/210, 211, 212; 16/116 R

[56] References Cited

U.S. PATENT DOCUMENTS

| | | | |
|---|---|---|---|
| 4,282,938 | 8/1981 | Minamidate | 173/162.1 |
| 4,401,167 | 8/1983 | Sekizawa et al. | 173/162.1 |
| 5,269,381 | 12/1993 | Oscarsson | 173/162.2 |
| 5,322,131 | 6/1994 | Pressley et al. | 173/162.1 |

*Primary Examiner*—Scott A. Smith
*Attorney, Agent, or Firm*—Randall S. Wayland

[57] ABSTRACT

An isolator for use in a hand-held vibrating device for providing optimum vibration isolation by utilizing elastomeric sections. Six embodiments are shown which utilize elastomer sections to enhance vibration isolation along an axial direction of vibration. A first embodiment includes a frustoconical section, while the second employs a W-shaped buckling element. A third embodiment includes use of a tuned fluid inertia which is tuned to substantially coincide with a predominant operating frequency of the vibrating device and produces forces to substantially reduce the vibration transmission, while three other embodiments employ metallic buckling springs. Another embodiment employs a tuned vibration absorber and still another combines a tuned mass with a buckling column.

21 Claims, 10 Drawing Sheets

ISOLATED HAND-HELD VIBRATING DEVICE

CROSS-REFERENCE TO RELATED APPLICATIONS

The present application is a continuation of application Ser. No. 08/663,155 filed Jul. 26, 1995, now U.S. Pat. No. 5,839,517 which was a continuation-in-part application of Ser. No. 08/009,695 filed on Jan. 27, 1993, now abandoned.

FIELD OF THE INVENTION

This invention relates to the area of vibration isolators. Specifically, the invention relates to the area of elastomer-containing vibration isolators for isolation of a user from mechanical vibrations of hand-held vibrating devices.

BACKGROUND OF THE INVENTION

One of the problems facing users of hand-held vibrating equipment is exposure to elevated mechanical vibration levels. Long term exposure has produced symptoms of vascular, nervous system and bone/muscle deterioration such as hand-arm vibration syndrome and white hand. Many have attempted to solve the problem of excessive vibration transmitted to the users of hand-held tools by incorporating elastomer elements between the user and the vibrating device. Approaches have attempted to isolate and/or damp the mechanical vibration of the device.

One such isolating approach is taught in U.S. Pat. No. 3,968,843 to Shotwell, which is hereby incorporated by reference, and provides a pneumatic air hammer with a shock and vibration-absorbing insert or cushion member 30 between the body of the tool 10 and the handle 19. The isolator used is a plain compression-type sandwich isolator. Its theory of operation is to place a soft spring between the user and the vibrating device, thus isolating the user from mechanical vibration. However, compression-type isolators have one serious drawback. They experience an inherent stiffening effect when the operator exerts an increased force on the tool. This is due to the inherent strain sensitivity of elastomer in compression. Because of this, as the force increases, the level of vibration felt by the user is worsened. In other words, the harder the operator pushes the more ineffective the isolator becomes.

In addition, in order to maintain control of the tool, the cocking and torsional motions of the tool must be restrained. U.S. Pat. No. 2,500,036 to Horvath uses dual resilient members 80 and 81 to allow limited axial movement and restrain cocking. It also uses a plurality of locking segments 85 to restrain torsional rotation of the handle member 13 relative to the barrel 10.

In U.S. Pat. No. 5,054,562 to Honsa et al., an isolator which was to provide axial vibration isolation as well as cocking/torsional control by surrounding the working cup 20 with laminar layers of elastomer is described. Although this makes for a convenient package, this has the same inherent problem of compression strain stiffening as the Shotwell '843 approach.

As taught in U.S. Pat. No. 4,401,167 to Sekizawa et al., others have attempted to place the elastomer elements 6*a* and 6*b* between the tool body 1 and the handle 2. Although placing the elastomer in shear substantially eliminates the strain stiffening effects, it cannot provide low enough stiffness for optimum control and still maintain control of the tool.

Further attempts to improve the vibration isolation characteristics of hand-held tools have included the addition of fluid damping to the isolator. By adding damping, over and above what is available from an elastomeric device alone, the vibrations emanating from the tool can be further reduced. U.S. Pat. No. 4,667,749 to Keller, which is hereby incorporated by reference, describes such an isolator which adds fluid damping to an isolator and which is suitable for mounting a handle to a vibrating tool body.

Further, U.S. Pat. No. 4,236,607 to Hawles et al. describes a vibration suppression system wherein the fluid passes through the inner member of the mounting to provide amplified counter inertial forces. The commonly assigned U.S. Pat. No. 4,969,632 issued to Hodgson et al. and U.S. Pat. No. 4,733,758 issued to Duclos et al., which are both hereby incorporated by reference, describe other tunable mountings.

SUMMARY OF THE INVENTION

The present invention has been designed to provide an improved vibration isolator for reducing the mechanical vibration level transmitted to the user in order to overcome the features and shortcomings of the available mountings for vibrating hand-held devices and tools.

According to the invention, a isolator for use in a vibrating hand-held device is provided with a spring rate characteristic which preferably softens as the operator increases the force applied to the device thereby improving the vibration isolation and solving the stiffening effect inherent in the isolators used in prior art hand-held vibrating devices.

Further, the invention provides an isolator for use in a hand-held vibrating device which exhibits a spring rate characteristic for the mounting which softens by about a factor of 2 or more, and more preferably, about softens by about a factor in the range of 2 to 2, with increased application of force by the operator thus improving the vibration isolation.

The present invention also provides an elastomeric isolator for a hand-held vibrating device which uses a buckling section incorporated into the isolator within the hand-held vibrating device.

Also, the present invention also provides a buckling section isolator for incorporation into the vibrating device which comprises a means for allowing axial vibration isolation of the tool body relative to the tool handle and means incorporated therein for restraining torsional rotational and cocking of the tool body relative to the tool handle essential for control of the vibrating device.

According to another aspect, the present invention also provides a buckling elastomer isolator for incorporation into the vibrating device which includes a means for snubbing to prevent unwanted excess motions.

In another aspect, the invention includes an elastomeric grip isolator for use on a vibrating device which is a means for providing radial vibration isolation to the user by incorporating multiple radial buckling elements into the grip isolator.

The present invention further includes an elastomeric and fluid isolator for use on a vibrating hand-held device which comprises a means for providing vibration isolation of the user at a discreet operating frequency by incorporating inertial fluid forces within the elastomeric and fluid isolator, for example.

In another aspect, the invention includes an elastomeric and tuned mass isolator for use on a vibrating hand-held device which is a means for providing vibration isolation of the user at a discreet operating frequency by incorporating inertial forces within the vibrating device.

Moreover, the invention further includes a buckling isolator for use on a vibrating hand-held device wherein said buckling isolator includes metal buckling elements for providing vibration isolation of the user.

In a more detailed aspect of present invention is provided an elastomeric and fluid isolator for use on a vibrating hand-held device which includes a means for providing vibration isolation of the user at a discreet operating frequency by incorporating inertial fluid forces within the elastomeric and fluid isolator and which utilizes a buckling section within the isolator.

In summary, it is a feature of the instant invention to provide the above mentioned objects by providing a vibration isolator for use on a hand-held vibrating device for reducing the mechanical vibration imparted to the user, comprising a handle for being grasped by said user; a tool body; and a vibration isolator attached between the handle and the tool body, said vibration isolator including a buckling section which buckles under application of load, thus reducing the spring rate within an operating range and reducing said mechanical vibration imparted to said user within said operating range.

According to another feature, the invention is a hand-held vibrating device for reducing the mechanical vibration imparted to the user, comprising: a tool handle graspable by a user, a tool body moveable relative to said tool handle, said tool body adapted to receive a tool, a vibration isolator attached between said tool handle and said tool body, said isolator including: first end member attached to said handle, said first member including a first radially extending flange including a first axial face, a second end member attached to said tool body, said second end member including an axially directed section extending towards said first axial face of said first end member and including an external peripheral surface; and an elastomeric element bonded between said first axial face of said radially extending flange and said external peripheral surface.

It is an additional feature to provide an elastomeric vibration isolator for use on a hand-held vibrating device which reduces the radial mechanical vibration imparted to the user, comprising a body of elastomer for being grasped by said users hand, said body of elastomer disposed about a central axis; multiple buckling sections extending radially inward toward said central axis, said buckling sections buckling under application of load and reducing the spring rate which improves radial vibration isolation.

It is another feature of the instant invention to provide a hand-held vibrating device which reduces the mechanical vibration imparted to the user, comprising: a handle for being grasped by said user; a tool body; a tool bit attached to said tool body; a buckling isolator attached between said handle and said tool body, said buckling isolator including a buckling section which buckles under application of load along an axial axis, thus reducing the spring rate and improving the axial vibration isolation; a grip isolator further including a body of elastomer for being grasped by the users hand, said body of elastomer disposed about a central axis and surrounding one selected from the group consisting of said tool bit and said tool body, multiple buckling sections extending radially inward toward said central axis, said multiple buckling sections buckling under application of load and reducing the spring rate and improving the radial vibration isolation.

It is also a feature of the instant invention to provide a hand-held vibration device including a fluid and elastomer vibration isolator for use between a handle and a tool body, comprising: a first variable volume chamber; a second variable volume chamber; a first flexible element defining at least a portion of said first variable volume chamber; a second flexible element defining at least a portion of said second variable volume chamber; a fluid passageway between said first and second variable volume chambers; a fluid contained within, and substantially filling, said first variable volume chamber, said second variable volume chamber, and said fluid passageway; whereby vibrations of said tool body cause said fluid to flow within said fluid passageway between said first variable volume fluid chamber and said second variable volume fluid chamber and create forces which reduce the vibration transmitted to said handle.

It is an advantage of the present invention that the lower stiffness, as compared to conventional isolators at the optimum operating load, reduces the vibrating forces transmitted to the user.

It is an advantage of the present invention that the buckling element incorporated into the isolators can reduce the vibration experienced by the user.

It is a further advantage of the present invention that the axial isolation can be dramatically increased without reducing the control of the vibrating device by restraining both cocking motion and torsional motion of the tool handle relative to the tool body.

It is a further advantage of the present invention that the axial isolation can be dramatically increased by tuning an amplified fluid inertial force to coincide with the operating frequency.

The above mentioned and further features, advantages and characteristics of the present invention will become apparent from the accompanying descriptions of the preferred embodiment and attached drawings.

BRIEF DESCRIPTION OF THE DRAWINGS

The accompanying drawings which form a part of the specification, illustrate several embodiments of the present invention. The drawings and description together, serve to fully explain the invention. In the drawings.

FIG. 7A' is an enlarged cross-sectional side view of an individual spring element of the isolator of FIG. 7A with the buckled position shown in dotted line;

FIG. 7B' is an enlarged cross-sectional side view of an individual spring element of the isolator of FIG. 7B with the buckled position shown in dotted line;

FIG. 7C'is an enlarged cross-sectional side view of an individual spring element of the isolator of FIG. 7C with the buckled position ghosted in.

DETAILED DESCRIPTION OF THE INVENTION

Figure 1A:
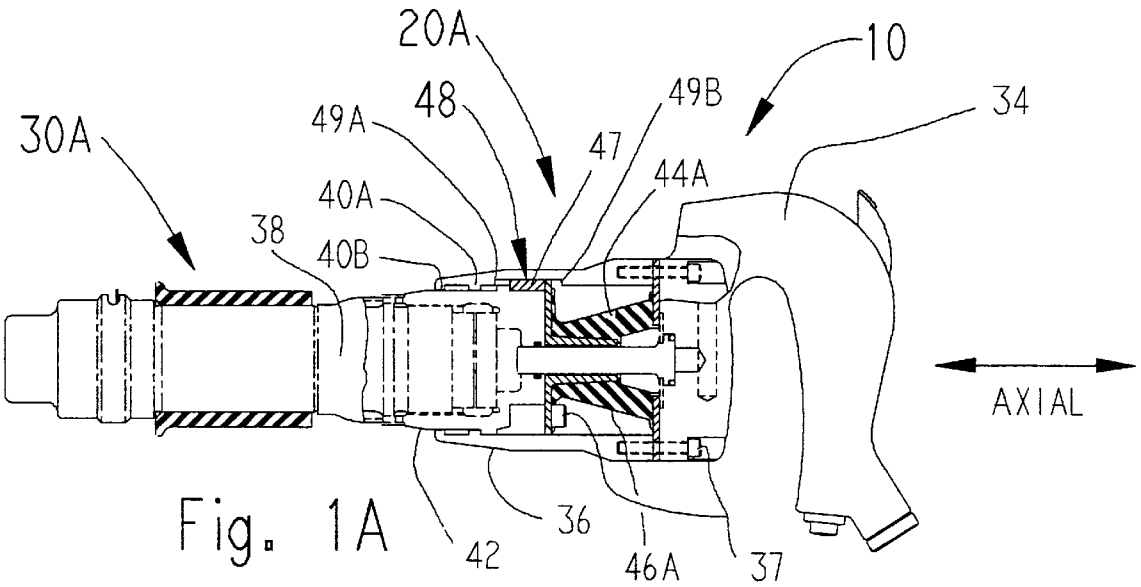
FIG. 1A is a partially sectioned side view showing the installation of an embodiment of the buckling isolator and an embodiment of the grip isolator on a hand-held vibrating device.

In FIG. 1A, an embodiment of a buckling isolator 20A and a separate embodiment of a grip isolator 30A are shown installed in the environment of the hand-held vibrating device 10. The vibrating device 10 that is used to illustrate the present invention is a pneumatic air hammer, but the buckling isolator 20A and grip isolator 30A are equally effective, when properly situated, for any type of hand-held vibrating equipment or device. The pneumatic air hammer or vibrating device 10 in the present invention includes a tool bit 32 (FIG. 1B) which is preferably steel and which contacts the work piece (not shown). The vibrating device 10 also includes a handle 34 which is grasped by a first rear hand of the user. Further, the handle attaches to a sleeve 36 that is preferably cylindrically shaped. However, a sleeve integrated into a handle may be envisioned, as well.

One end of the buckling isolator 20A attaches to the handle 34 by way of bolts or other fastening means 37. The other end of buckling isolator 20A is attached to the tool body 38 by bolts or other fastening means 37. The buckling isolator 20A attaches between the tool body 38 and the handle 34 and allows the tool body 38 to deflect axially and thus acts as an isolator spring between the tool body 38 and handle 34. The axial motion is limited by a snubber 48. The snubber consists of a collar 47 which is part of or alternatively contact the ends of the collar 47 at the excursion limits. By way of example and not by limitation, the snubber 48 constrains the movement in the axial direction to 0.4 inch (in.) maximum compression deflection and 0.1 inch (in.) tensile deflection.

In order to maintain control of the vibrating device 10, it is important to keep the torsional and cocking stiffness of the vibrating device 10 as high as possible. Contrarily, in order to isolate the user from vibration, it is desirable to keep the axial stiffness as low as possible. These are competing criteria and usually both are not obtainable because, as the axial stiffness is reduced, by reductions in elastomer thickness and/or modulus, the cocking and torsional stiffnesses are also reduced. Low cocking and torsional stiffnesses make for poor tool control.

In the present invention, the tool body 38 is restrained from cocking relative to the sleeve 36 and, thus also, the handle 34 by way of sliding surfaces 40A and 40B which are axially spaced and which lightly contact the outer periphery 42 of the tool body 38. The sliding surfaces 40A and 40B and/or outer peripheries 42 are coated with Teflon® or other suitable means for reducing friction. This allows the tool body 38 to slide telescopically within the sleeve 36 and compress axially the elastomeric buckling section 44A of the buckling isolator 20A, thus reducing the spring rate in the axial direction within a working thrust load range to be described later.

Figure 2C:
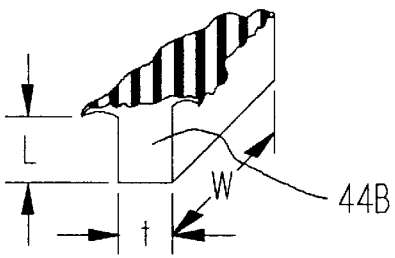
FIG. 2C is an enlarged partial isometric view illustrating one of the buckling sections of the grip isolator.
Figure 2B:
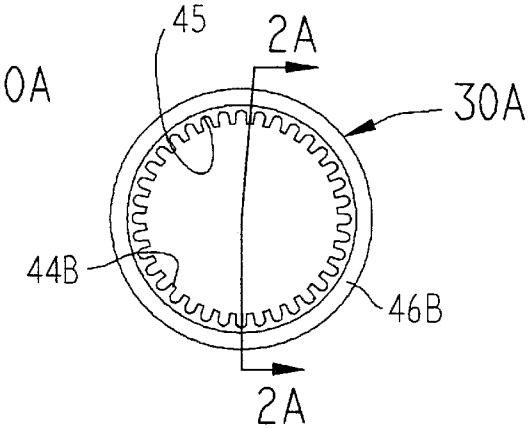
FIG. 2B is an end view illustrating an embodiment of the grip isolator and illustrating the multiple buckling sections.
Figure 2A:
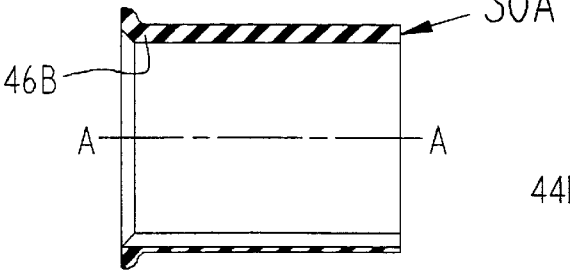
FIG. 2A is a sectioned side view illustrating an embodiment of a grip isolator for a hand-held vibrating device as seen along line 2A—2A in FIG. 2B.
Figure 2D:
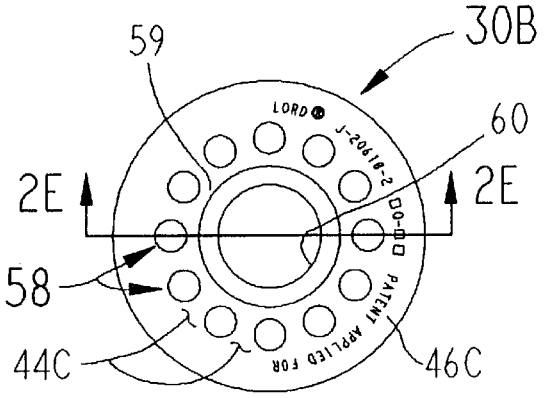
FIG. 2D is an end view illustrating another embodiment of the grip isolator and shows the multiple buckling sections.
Figure 2F:
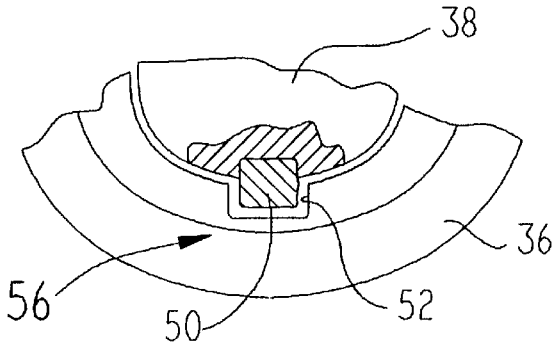
FIG. 2F is an enlarged end view with a portion broken away illustrating the means for restraining torsional motion for the vibrating device.

As shown in FIG. 2F, in order to restrain torsional motion, splines or keys 50 which are added on the tool body 38 are received within grooves 52 formed in the sleeve 36. Together, the splines or keys 50 and grooves 52 comprise the means for restraining torsional movement 56, while allowing unrestricted axial motion. Other means of restraining torsional movement such as flats and non-round shapes are also acceptable. Again, referring to FIG. 1A, the sliding surfaces 40A and 40B together with the outer periphery 42 of the tool body 38 act as the means for restraining cocking motion while allowing relatively unrestricted axial motion.

The cocking and torsional modes are restrained, but axial displacement of the tool body 38 relative to the handle 34 can occur by compressing the buckling isolator 20A. The buckling isolator 20A achieves a much lower axial spring rate than prior art devices. When the user provides an axial force to the handle 34 along the axial axis, that force will compress the buckling isolator 20A and cause the elastomeric section 44A to undergo buckling. The elastomeric section 44A will experience a high static stiffness initially, yet as more force is applied and the elastomeric section 44A starts to buckle, the force needed to maintain the section in buckling falls off dramatically. After reaching this fall off point, or what is known as the "knee" in the spring rate curve, an operating zone (or working thrust load range) is reached where the spring rate is very low. Normally, within this zone the spring rate is in the range of 2 to 30 times lower than the initial static spring rate. It can even drop off more with proper sizing of the elastomeric section 44A. Within this operating range, maximum vibration isolation is achieved. A full description of buckling elastomer sections can be found in U.S. Pat. No. 3,798,916 to Schwemmer, U.S. Pat. No. 3,948,501 to Schwemmer, U.S. Pat. No. 3,280,970 to Henshaw, and Re 27,318 to Gensheimer which are all hereby incorporated by reference herein.

By way of example and not by limitation, the initial static spring rate of the buckling isolator is 375 lbf/in at 5 lbf load and at the operating load of 40 lbf the spring rate is 15 lbf/in. The buckling isolator 20A provides axial vibration isolation superior to the prior art compression-type isolators and fluid damped mounts for vibrating hand-held devices. However, in some instances, radial vibration can impart severe vibration to the user, in spite of the isolator 20A as a result of the key 50 hammering in keyway 52.

Figure 1B:
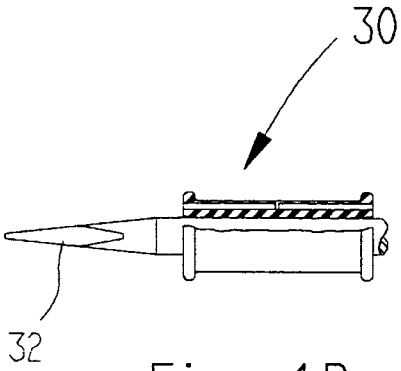
FIG. 1B is a partially sectioned side view showing a second embodiment of the grip isolator.

In FIGS. 2A and 2B, a first embodiment of a grip isolator 30A is shown. The grip isolator 30A functions both as a grip for the user to grasp the vibrating device 10 and also as a radial and axial isolator to isolate the user from radial and axial mechanical vibration emanating therefrom. The grip isolator 30A can be installed on the vibrating device 10 at an point which is convenient, such as tool body 38 (FIG. 1A). Alternatively, the grip isolator 30B could encircle the tool 32 (FIG. 1B). In some instances, this latter embodiment will be preferred as many operators desire to grip the hammer 10 as far forward as possible for improved balance.

The grip isolator 30A includes a body of elastomer 46B, a multiple number of buckling sections 44B extending radially inward from the body of elastomer 46B toward a central axis A. As shown in FIG. 2C these buckling sections 44B have a length L (in.), a width W (in.), a thickness t (in.), and are molded of elastomer with a shear modulus G (psi). The parameters L, W, t, and G can be chosen to provide the optimum buckling for the vibrating device 10 (FIG. 1A). The buckling sections are formed by substantially parallel slots 45 extending into said body of elastomer 46B. As fully set forth in the two Schwemmer patents and the patents to Henshaw and Gensheimer, in order to exhibit buckling, the sections must have a length to thickness ratio $L/t^3 2$.

Prior art grips have included foam rubber construction which has excellent vibration isolation characteristics; however, these grips quickly deteriorate due to abrasion, are of poor overall strength, and are subject to being contaminated with oil. Prior art natural rubber grips were more rugged than foam grips, but failed to properly isolate the user's hand. The present invention grip isolator 30A or 30B is slid over the member to be isolated 32 or 38, such that in its static form, the buckling sections 44B are buckled and the user is optimally isolated from the vibration (See FIG. 2G). The present invention provides a rugged grip that is capable of isolating the user from vibration.

Figure 2E:
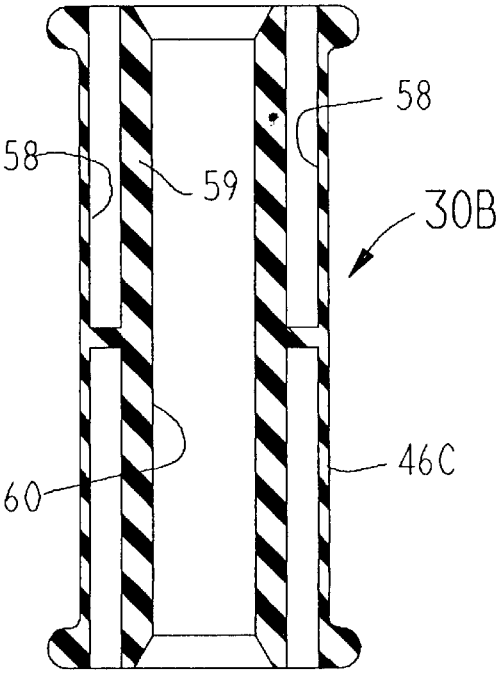
FIG. 2E is a sectioned side view illustrating an embodiment of a grip isolator for a vibrating device as seen along lines 2E—2E in FIG. 2D.
Figure 2G:
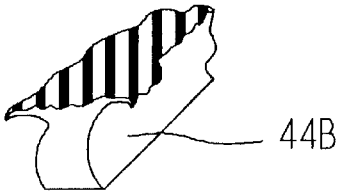
FIG. 2G is a partial end view illustrating one buckling section of the grip isolator in the buckled state.

A second embodiment of grip isolator 30B is illustrated in FIG. 2D and 2E. This embodiment is comprised of a body of elastomer 46C, but the buckling sections 44C are formed by a series of substantially parallel cores or bores 58 extending into the body of elastomer 46C. The large bore 60, as installed, has an interference fit with the member to be isolated, such as a tool bit 32 (FIG. 1B) or tool body 38 (FIG. 1A). An intermediate wall 59 (FIG. 2E) of elastomer provides radial stability to bores 58 while permitting axial softness of the isolator 30B. By pressing the grip isolator 30B over the member to be isolated, the buckling sections 44C (FIG. 2D) are buckled and as a result the radial spring rate is lowered substantially.

In this embodiment, the buckling sections 44C have low combined axial stiffness to provide isolation from axial vibrations. This configuration is preferred for usage in the FIG. 1B environment where the axial vibration will be pronounced. The soft elastomer which is used preferably has a hardness in the range of 30 to 100 durometer. Ideally, soft natural rubber with a shear modulus of approximately 75 psi should be used for the grip isolator 30A and 30B.

Figure 2H:
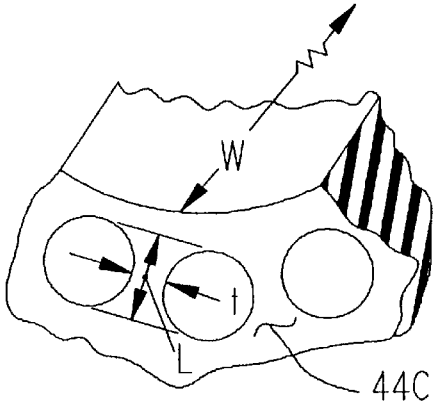
FIG. 2H is an enlarged partial end view illustrating the dimensions of the buckling section of the grip isolator.

FIG. 2H illustrates the buckling sections 44C having a length L, a width W, a thickness t, and which are molded of elastomer with a shear modulus G. The parameters L, W, t, are chosen to make the buckling section 44C buckle properly for the application. Other shapes of bored out or cored out sections can be envisioned which will allow buckling, such as rectangular, triangular, and sections which direct the buckling direction.

Figure 3C:
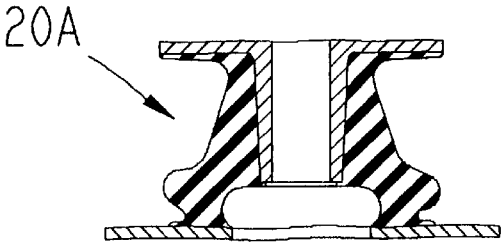
FIG. 3C is a side view of the first embodiment of the buckling isolator shown in the buckled state.
Figure 3A:
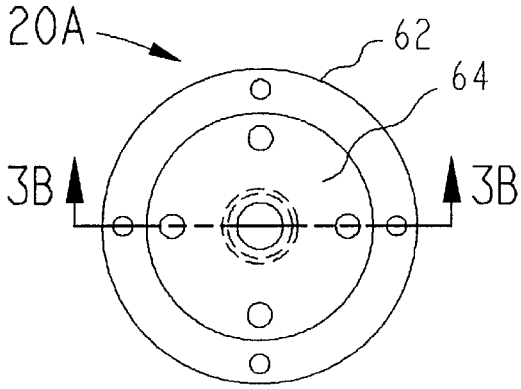
FIG. 3A is a top view of a first embodiment of the buckling isolator.
Figure 3E:
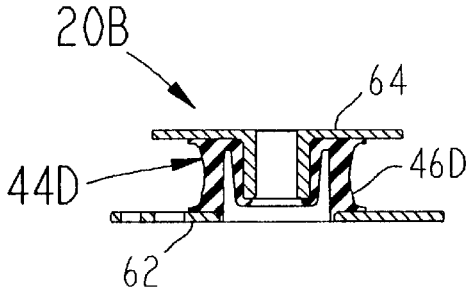
FIG. 3E is an enlarged partially sectioned side view of the second embodiment of the buckling isolator.
Figure 3B:
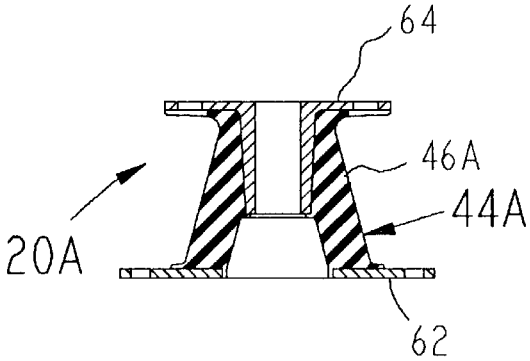
FIG. 3B is a sectioned side view of the buckling isolator as seen along line 3B—3B in FIG. 3A.

A view of a first embodiment of buckling isolator 20A is illustrated in FIG. 3A and 3B. The isolator 20A is comprised of a first end member 62, a second end member 64, and a body of elastomer 46A integrally bonded to the members 62 and 64. The body of elastomer 46A includes a buckling section 44A which buckles outwardly under the application of load as shown in FIG. 3C.

Figure 3D:
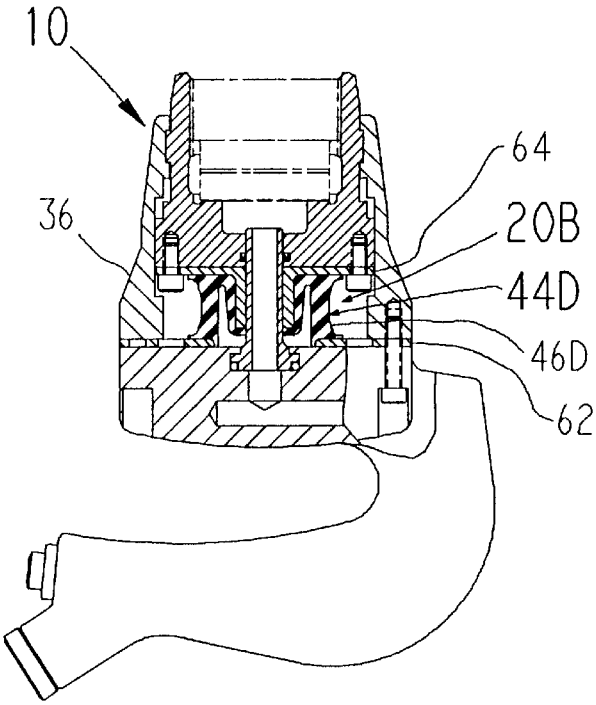
FIG. 3D is a partially sectioned side view of another embodiment of the buckling isolator for use in a hand-held vibrating device.

FIGS. 3D and 3E illustrate another type of buckling isolator 20B for use in a hand-held vibrating device 10. This buckling isolator 20B has a slight taper from either end member 62 and 64 on the outside surface of the body of elastomer 46D such that the center most portion is thinnest. This is to promote inward directional buckling of the W-shaped buckling section 44D. When the extended throw available with the FIG. 1A embodiment is unnecessary, this second embodiment offers a more compact envelope.

Figure 4A:
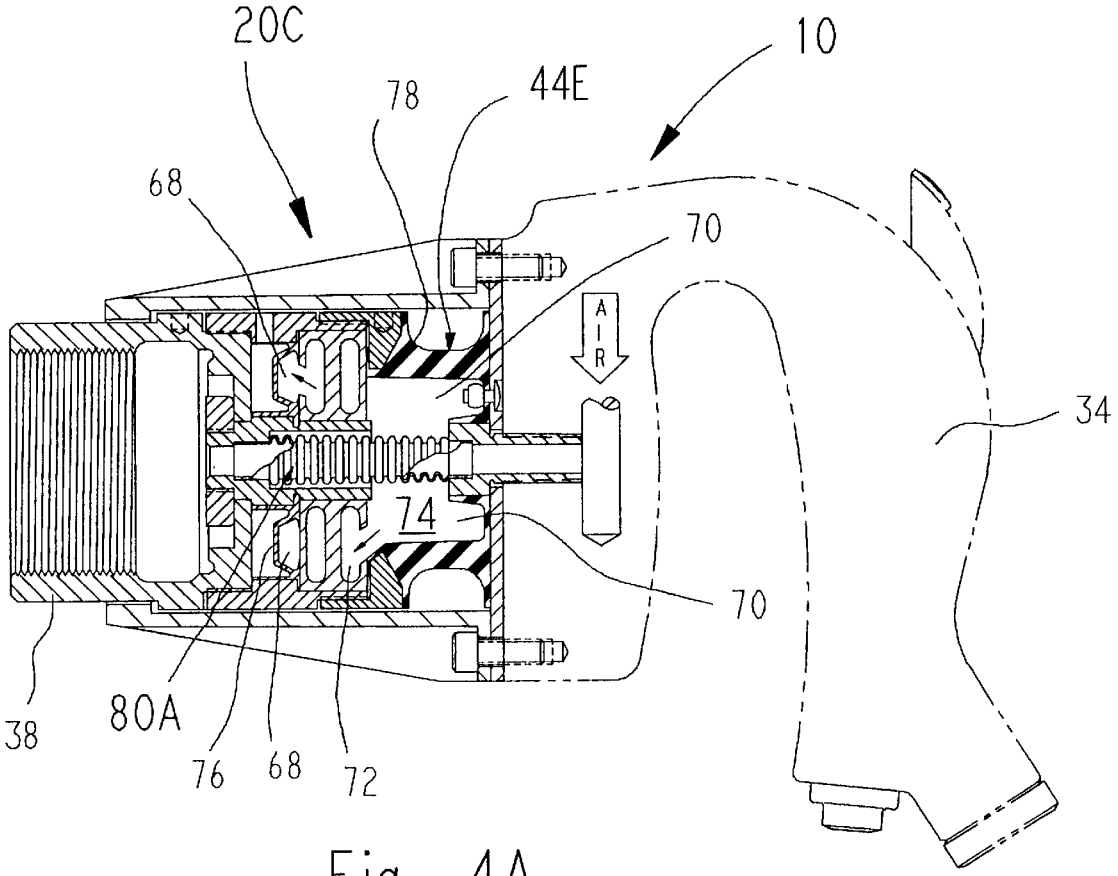
FIG. 4A is a sectioned side view of an embodiment of a fluid and elastomer isolator installed within a hand-held vibrating device.

In FIG. 4A a fluid-and-elastomer version of the buckling isolator 20C is shown. The buckling isolator 20C includes a first variable volume fluid chamber 68, a second variable volume fluid chamber 70 and a fluid passageway 72 which allows for fluid communication between the chambers 68 and 70. Fluid 74 substantially fills, and is contained within, the chambers 68 and 70 and the fluid passageway 72. The theory of operation of the fluid and elastomer isolator is simple. As the air pulses enter the device 10 through an air passage or air supply tube 80A and excite the tool body 38, the tool body 38 oscillates correspondingly. The dynamic oscillation of the tool body 38 relative to the handle 34 will cause the buckling section 44E to flex dynamically. This will pump fluid 74 from one chamber 68 to the other 70. Because of the differential in area between the fluid passageway 72 and the fluid chambers 68 and 70, and the transmissibility at resonance of the fluid 74, the fluid 74 can be accelerated to very large velocities as it flows through the passageway 72 and can generate significant phased counter inertial forces. As a result, with proper tuning, these inertial forces can be tuned to provide a dynamic stiffness notch at a predominant operating frequency. This will substantially reduce the vibration transmitted to the user.

In this embodiment, a first flexible element 76 which defines a portion of the first variable volume fluid chamber 68 is a fabric reinforced diaphragm. The diaphragm accommodates temperature expansion and allows static displacement of fluid from one chamber to another. A second flexible element 78 which defines a portion of the second variable volume fluid chamber 70 includes the buckling section 44E.

The air passage 80A is a flexible bellows such as a steel spring bellows and passes through the second variable volume fluid chamber 70.

Figure 4B:
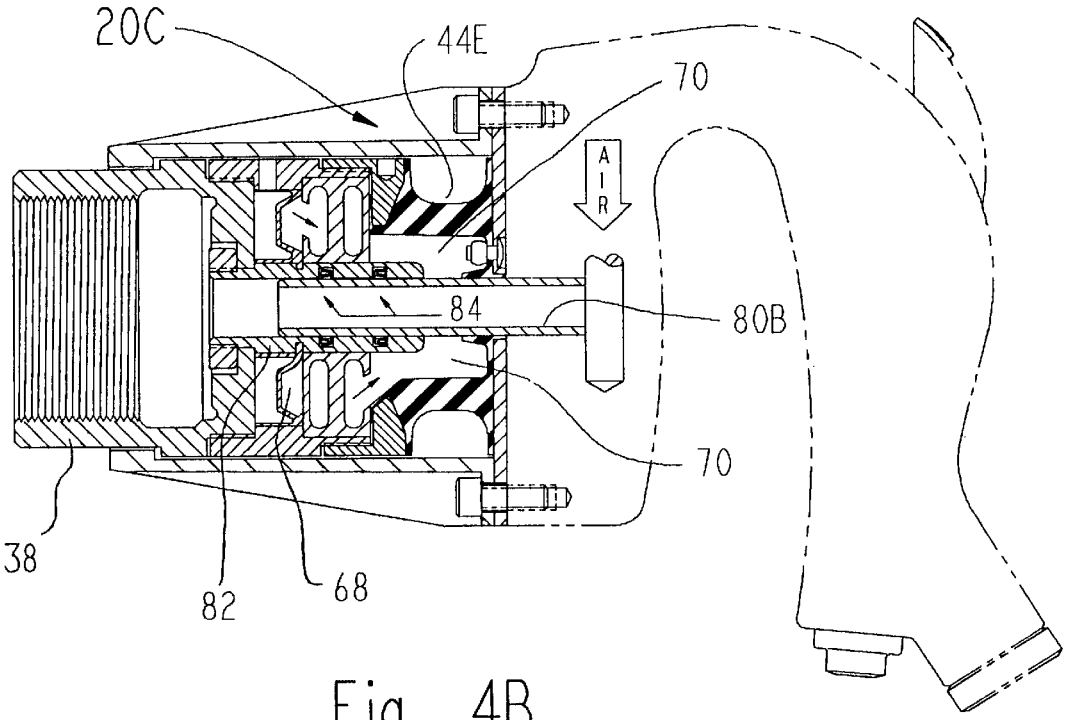
FIG. 4B is a sectioned side view of a second embodiment of a fluid and elastomer isolator.

In FIG. 4B a second embodiment of a fluid and elastomer version of the buckling isolator 20C is shown. The only difference between the embodiment shown in FIG. 4A and this one is in the construction of the air passage 80B. In this embodiment, the air passage 80B slides telescopically within a tube 82 attached to the tool body. A pair of seals 84 prevents fluid 74 from escaping from the chamber 68 and air from entering the chamber 68.

Figure 5A:
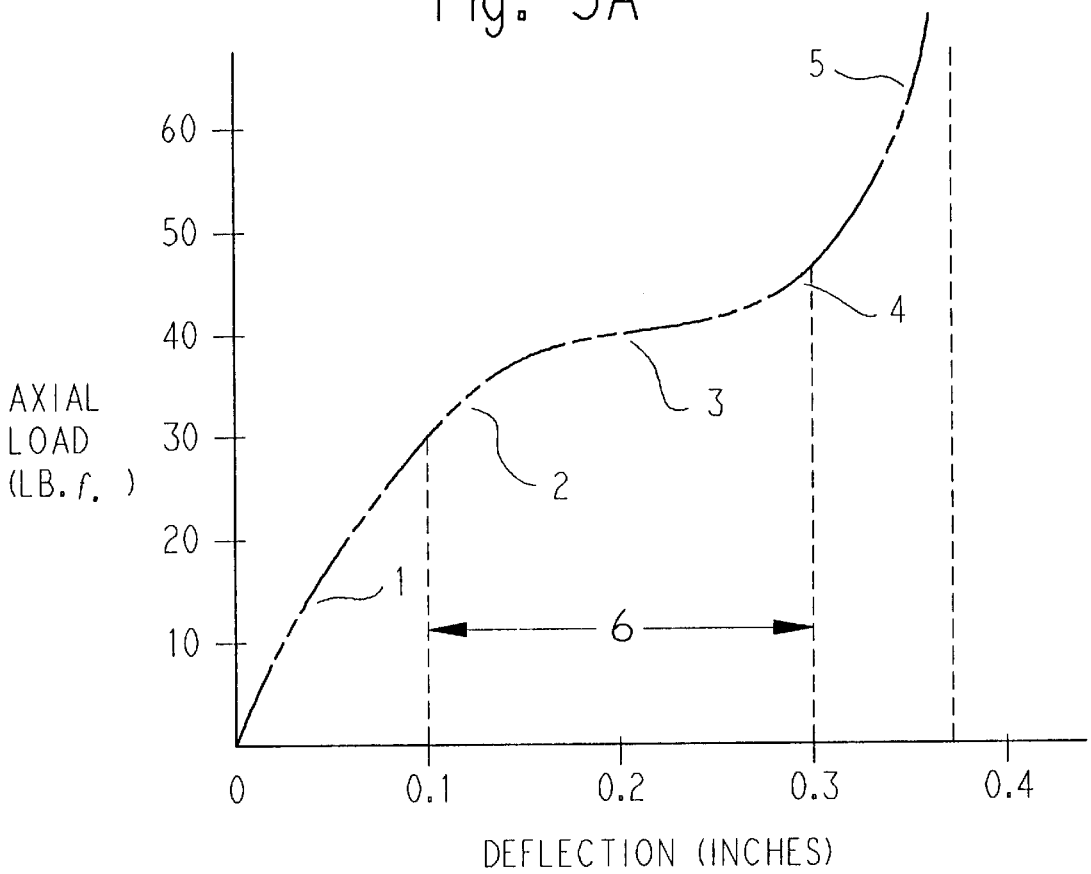
FIG. 5A is a graph illustrating the spring rate characteristics exhibited by the buckling isolator within the hand-held vibrating device.

In FIG. 5A a performance curve of the buckling isolators 20A, 20B, and 20C are shown. The performance curve plots axial load in pounds force (lbf.) on the vertical axis versus deflection in inches (in.) on the horizontal axis and is split into five different sections labeled 1 to 5. Section 1 of the curve illustrates the initial-low-strain spring rate, prior to the occurrence of any buckling. Section 2 illustrates the onset of buckling where the spring rate begins to fall off. Section 3 illustrates the optimum operating point where the tangent spring rate is the lowest. Section 4 is where the buckling section is so buckled that it begins to behave as a compression element and substantially stiffens. Section 5 is where the buckling section is bottomed out and begins to snub.

Figure 5B:
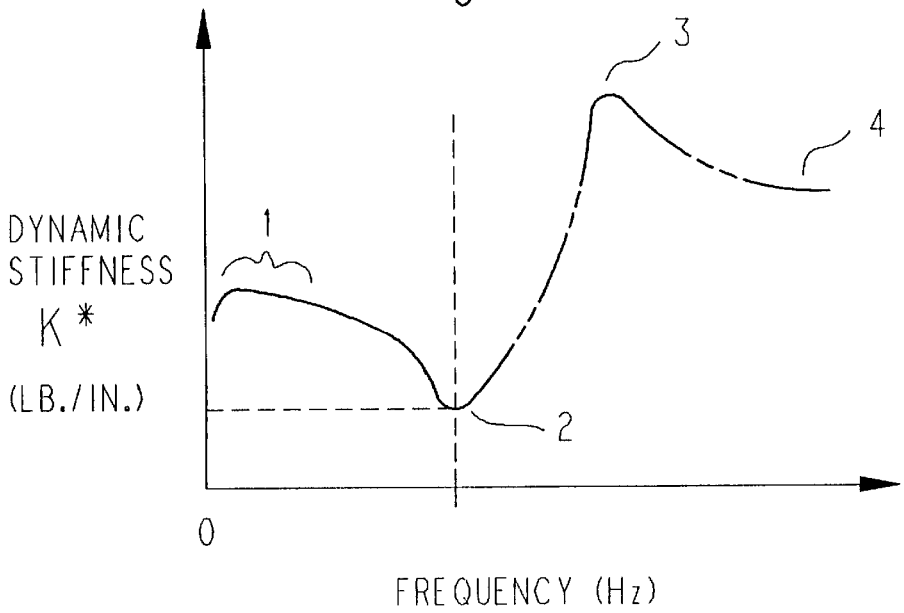
FIG. 5B is a graph illustrating the spring rate characteristics exhibited by the fluid and elastomeric isolator within the hand-held vibrating device.

In FIG. 5B a performance curve of a fluid and elastomer version of the buckling isolator 20C is shown. The curve section labeled 1 is the low frequency dynamic stiffness which is essentially the contribution due to the elastomer stiffness. Section 2 is the notch section. The notch is tuned to coincide with the fundamental frequency of input vibration by varying the functional characteristics of the fluid portion, e.g., the length of the inertia track, density of the fluid, etc. Section 3 is the peak dynamic stiffness and coincides closely with the fluid natural frequency. Section 4 is the high frequency stiffness after the fluid dynamically locks up and no longer flows through the fluid passageway.

Figure 6A:
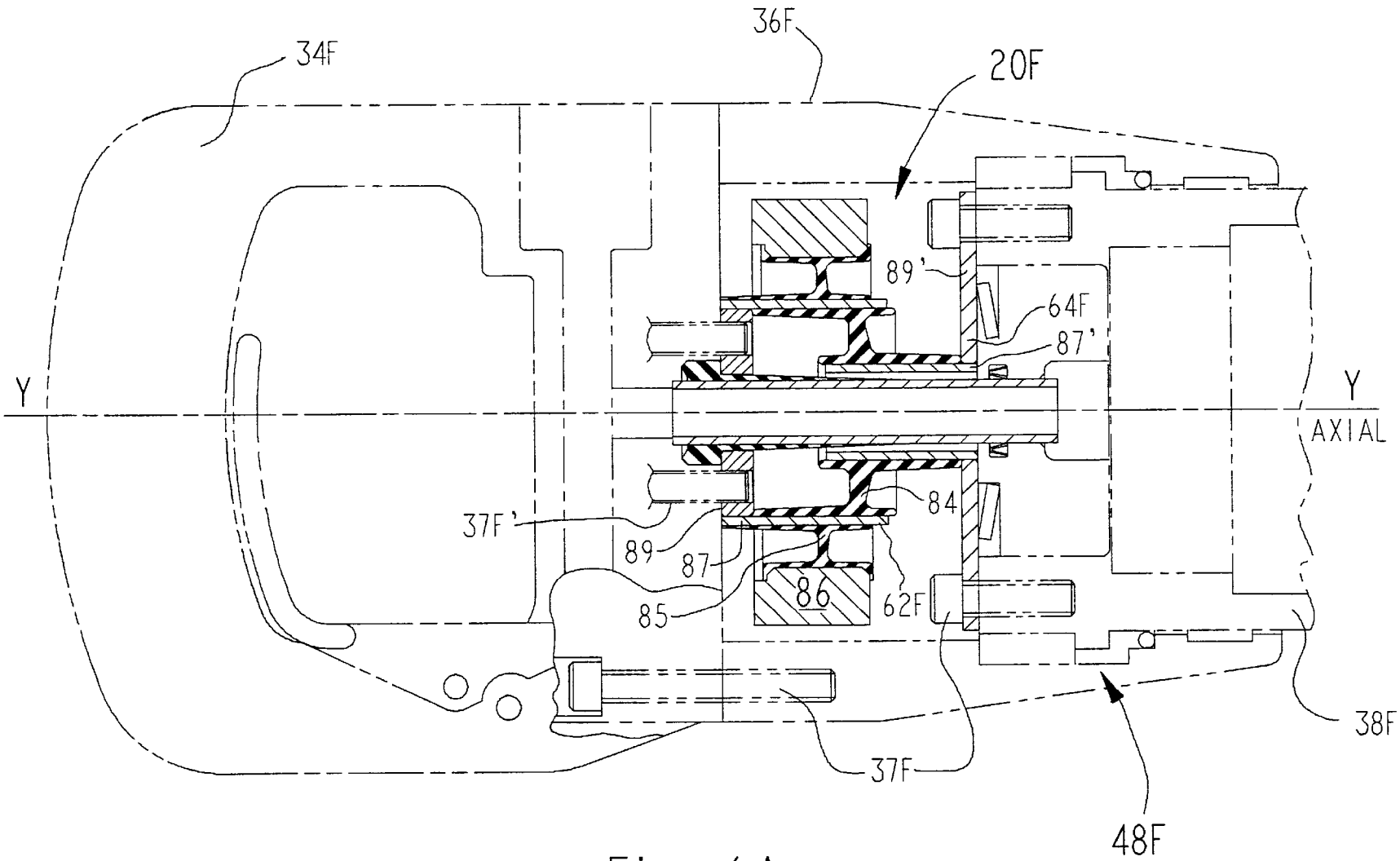
FIG. 6A is a sectioned side view of a third embodiment of an isolator for use in hand tools employing a tuned vibration absorber.

In FIG. 6A is described another embodiment of isolator 20F. This isolator 20F is useful for reducing the vibration transmitted to a user from a hand-held device and the like. In this embodiment, like numerals denote like elements as compared to the previous embodiments. The device is comprised of a handle 34F, a sleeve 36F attached to said handle 34F, and a tool body 38F similar to the previous embodiments. The main difference is that the reduction in spring rate within an operating range of frequency is accomplished by incorporating a first and second elastomer 84 and 85 and a suspended, tuned mass 86.

The first elastomer element 84 is a pure shear element, i.e., under axial loading along axis Y—Y, the first elastomer section 84 is placed in pure shear. The second elastomer section 85 is preferably also a pure shear section, but either could be a compression loaded section as well. The first elastomer section 84 is integrally and chemically bonded to the first end member 62F and the second end member 64F. The first end member includes a sleeve portion 87 and an attached plate portion 89 which is secured to the handle 34F. The second end member 64F is comprised of a sleeve portion 87' and an attached plate portion 89' which, in turn, attaches to the tool body 38F. The first elastomer section 84 provides a flexible connection between, and acts to isolate, the handle 34F from the tool body 38F by allowing relative axial motion therebetween. Snubber 48 limits the axial motion in a similar manner as the previous embodiments. The mass 86 is also integrally attached to and chemically bonded to the first end member 62F.

Mass 86 and second elastomer element 85 are tuned such that the mass 86 resonates at a frequency just above the frequency of interest, i.e., the motor frequency or air hammer frequency. The tuned frequency or natural frequency fn in Hz of the mass 86 can be approximated by the relationship $fn=1/2^1\ (K/M)^{1/2}$, where K is the shear stiffness (lb/in) in pounds per inch of the second elastomer element 85, and M is the mass of the mass 86. By way of example and not by limitation, the shear stiffness K=100 pounds per inch (lb/in), mass M=1 lb mass in pound seconds per inch squared (lb sec/in$^2$), and the resonant frequency is about 31 Hz. By tuning the natural frequency at 31 Hz and including this mass 86 on a typical chipper hammer, the operating range, for example, will be between about 28 and 31 Hz. Normally, the input vibration for a air hammer is about 30 Hz. This provides a reduction in the transmission of mechanical vibration to the user within the frequency range. Fasteners 37F and 37F' secure the first end member 62F and second end members 64F to the handle 34F and tool body 38F respectively.

Figure 6B:
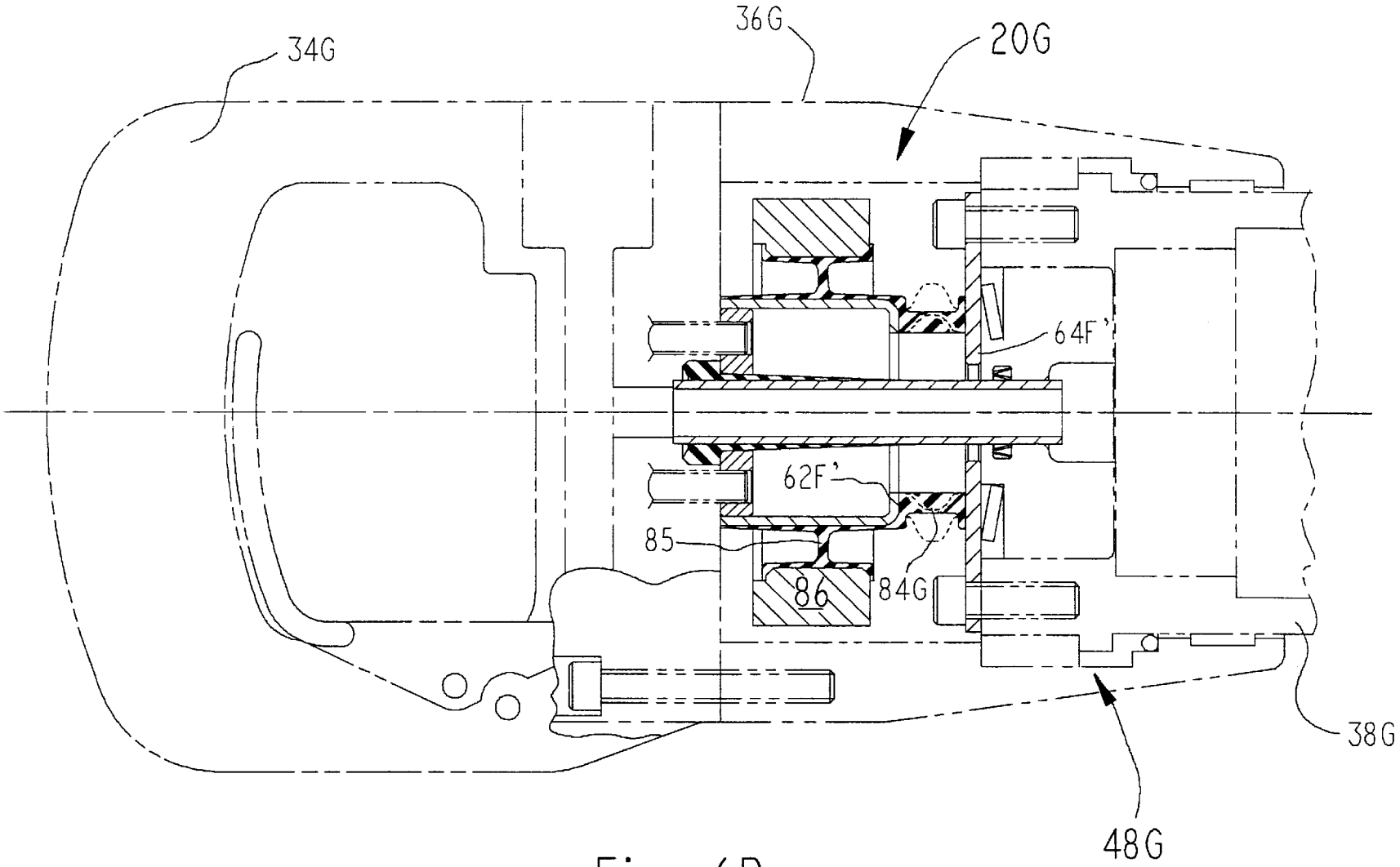
FIG. 6B is a sectioned side view of a fourth embodiment of an isolator for use in hand tools which uses a hybrid absorber/buckling column isolator.

FIG. 6B is another embodiment of isolator 20G. This embodiment is similar to the embodiment in FIG. 6A except the first elastomer element 84G is a buckling section. Buckling sections are described in the art in U.S. Pat. Nos. 3,948,501, 3,798,916, 3,280,970, and Re 27,318. The element 84G buckles radially inward (as shown in dotted lines) upon application of axial load. The mass 86 and second elastomer element 85 function as a tuned absorber as in the previous embodiment. In this case, the buckling section is preferably integrally and chemically bonded between the cup-shaped first end member 62F' and plate-like second end member 64F'. Upon buckling, the spring rate of the buckling section will drop off dramatically (by as much as 30 times or more) and provide a low spring rate for isolation of the user within a deflection range. The tuned absorber is comprised of mass 86 and elastomer element 85, which can further reduce the vibration imparted to the user.

Figure 6C:
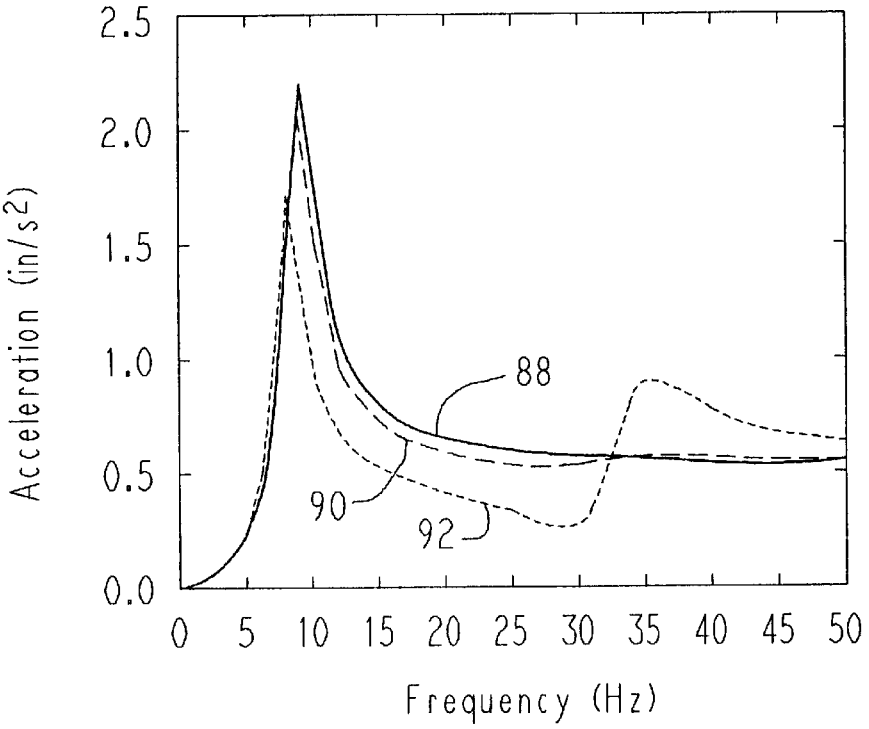
FIG. 6C is a graph illustrating the intended performance characteristics of the third embodiment of isolator within the hand-held vibrating device.

FIG. 6C is an illustration of the intended or analytical performance of the tuned absorber embodiment of isolator 20F of FIG. 6A. The solid line 88 indicates the analytical performance of the system without a tuned absorber and including a shear type first elastomer element 84 (FIG. 6A). The resonance at about 9 Hz is the system resonance. The curve indicated at 90 is for a system including a very small mass for the tuned mass 86 (FIG. 6A). The curve 92 illustrates a mass 86 (FIG. 6A) used it the experiment of about 1 (lb) pound in weight. Theoretically, for this example, a range of improved isolation can be seen between about 28–31 Hz where the peak accelerations are reduced.

Figure 6D:
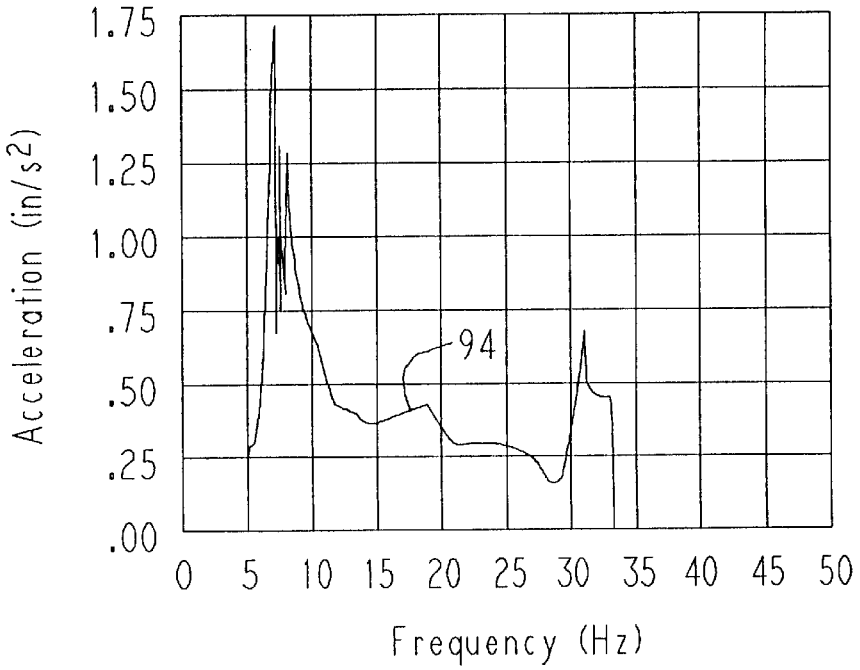
FIG. 6D is a graph illustrating the actual performance characteristics exhibited by the third embodiment of isolator within the hand-held vibrating device.

FIG. 6D is an illustration of the actual experimental performance of the tuned absorber embodiment of isolator 20F of FIG. 6A. The solid line 94 indicates the performance in peak acceleration in inches per second squared (in/s$^2$) as a function of frequency (Hz). As expected, the peak accelerations are substantially reduced within the operating range of about 28–31 Hz.

Figure 7A:
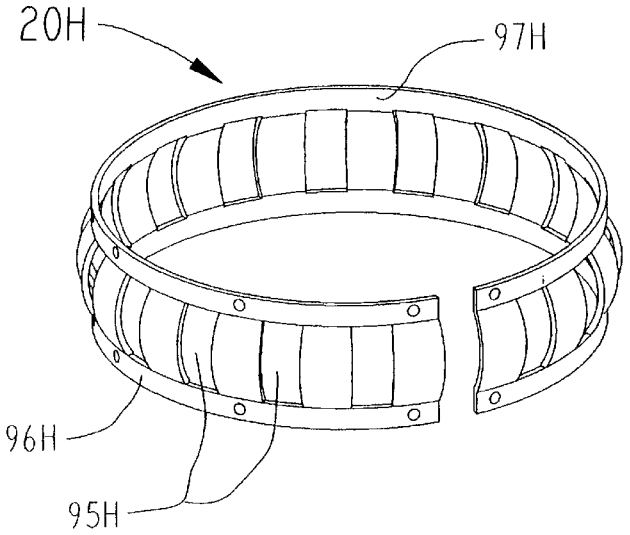
FIG. 7A is a perspective view of a fifth embodiment of the isolator of the present invention depicting the use of metallic bucking springs.
Figure 7A:
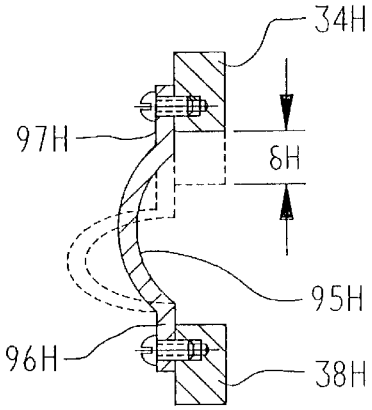

FIG. 7A is an illustration of another embodiment of buckling isolator 20H. The isolator 20H buckles radially outward under application of load such that the spring rate is reduced within a deflection range in a similar manner as the aforementioned elastomer embodiments. The isolator 20H is comprised of a series of buckling elements 95H extending between end portions 96H and 97H. End portions 96H and 97H attach to tool handle 34H and tool body 38H, respectively. Preferably the buckling elements 95H have a curvature formed thereon for biasing the buckling in one direction. The buckling elements 95H are preferably metal and are formed from a stamped and bent sheet and are preferably made of spring-type steel or are made into spring-type steel through an appropriate heat treatment operation. As shown in FIG. 7A', upon application of axial load, the buckling element 95H will buckle radially outward as shown in dotted lines. Upon buckling, the spring rate of the isolator drops off dramatically.

Figure 7B:
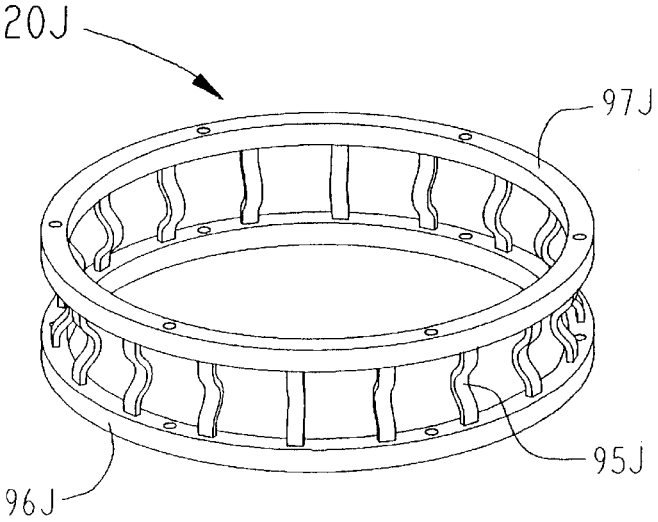
FIG. 7B is a perspective view of a sixth embodiment of the isolator of the present invention depicting a second form of metallic buckling spring.
Figure 7B:
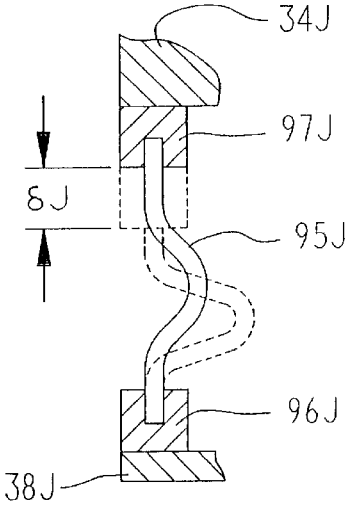

FIG. 7B is an illustration of another embodiment of buckling isolator 20J. This embodiment is functionally similar to the FIG. 7A embodiment except that the buckling elements 95J are not part of a stamped plate. The elements 95J are individual and preferably metal members of wire shape with a curvature formed thereon. The preferable cross section is rounded. The wire-type buckling elements 95J are fitted in recesses in end portions 96J and 97J. Again, preferably the buckling members 95J are made from spring steel or the like. Upon buckling, the axial spring rate is substantially reduced.

Figure 7C:
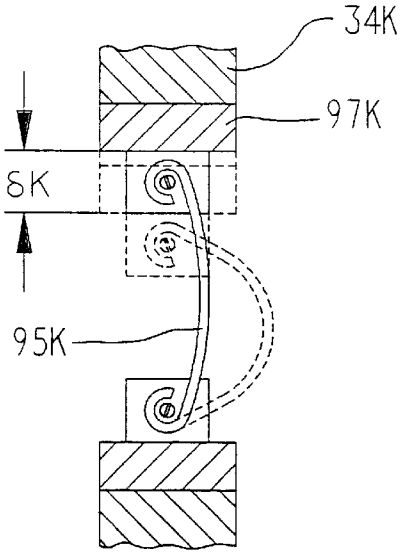
FIG. 7C is a perspective view of a seventh embodiment of the isolator of the present invention depicting a third form of metallic buckling spring.
Figure 7C:
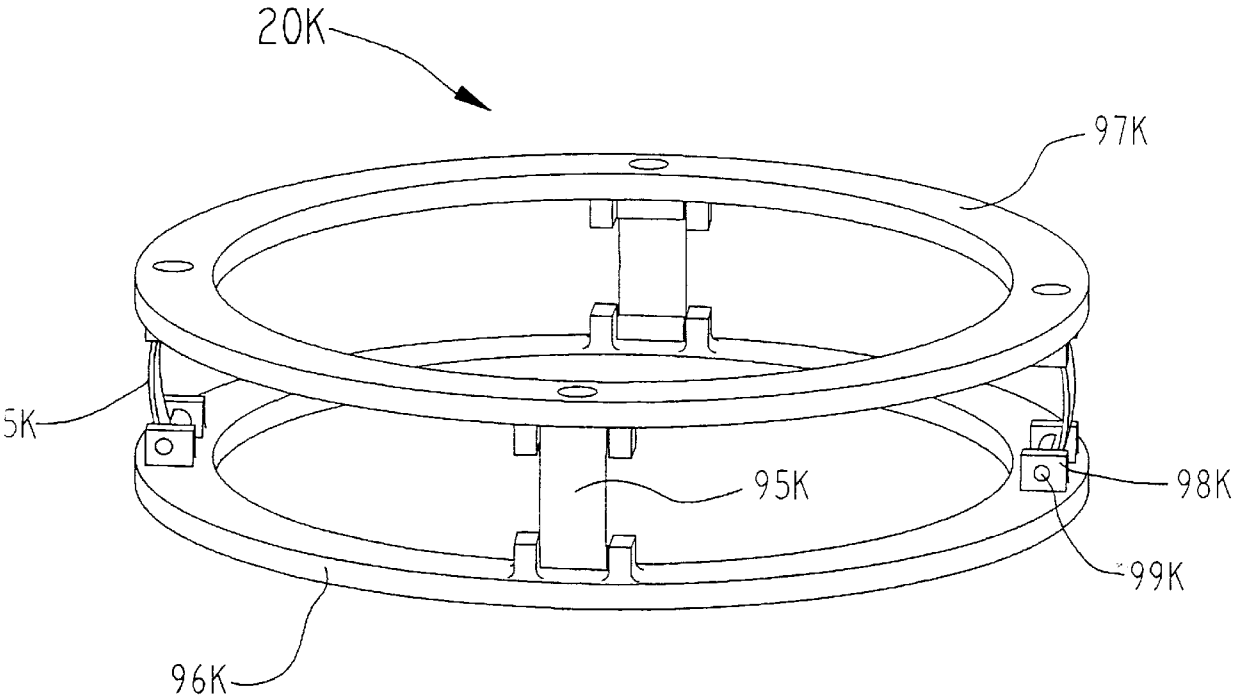

FIG. 7C is an yet another illustration of an embodiment of buckling isolator 20K. In this embodiment, the buckling elements 95K are strip members with coiled or wrapped ends for accepting pins 99K. The members 95K preferably have a curvature along their length to initiate or bias buckling in the proper direction. The members 95 are connected to clevises 98K or the like such that a pin joint is formed by pins 99K interacting with coiled ends at the interface with end portions 96K and 97K. FIG. 7C' illustrates the buckling element 95K in its buckled form. Upon buckling, the axial spring rate is substantially reduced.

In summary, the present invention relates to a vibration isolator for use on a hand-held vibrating device for reducing the mechanical vibration imparted to the user. One embodiment of isolator attaches between the tool body and the handle reduce the mechanical vibration within a range of frequency or deflection range. Embodiments are drawn to buckling elastomer type and buckling metal type isolators, tuned fluid isolators, and tuned mass isolators for reducing the spring rate within a range. In the buckling isolator embodiments, the buckling means attaches between a handle for being grasped by said user and a tool body and the initial spring rate is reduced within an operating range upon application of load. In the fluid isolator, a tuned fluid is used to generate counter inertial fluid forces for reducing the transmitted forces within a frequency range, while in the tuned absorber embodiment, the tuned mass and second spring are tuned to provide the vibration reduction within a frequency range. The grip isolator embodiment comprises multiple buckling means extending radially inward toward a central axis of said hand-held vibrating device for exhibiting an installed radial spring rate in a buckled condition which is lower than a spring rate in a non-installed condition. All of these isolators are intended to reduce the mechanical vibration imparted to the user and reduce or eliminate the incidence of "white hand" or other physiological deterioration.

While several embodiments of the present invention have been described in detail, various modifications, alterations, changes and adaptations to the aforementioned may be made without departing from the spirit and scope of the present invention defined in the appended claims. It is intended that all such modifications, alterations and changes be considered part of the present invention.

What is claimed is:

1. A hand-held vibrating device for reducing the mechanical vibration imparted to the user, comprising:

(a) a tool handle graspable by a user, (b) a tool body moveable relative to said tool handle, said tool body adapted to receive a tool, and (c) a vibration isolator attached between said tool handle and said tool body, said isolator including:

(i) first end member attached to said handle, said first member including a first radially extending flange including a first axial face;

(ii) a second end member attached to said tool body, said second end member including an axially directed section extending towards said first axial face of said first end member and including an external peripheral surface; and (iii) an elastomeric element bonded between said first axial face of said radially extending flange and said external peripheral surface.

2. A device of claim 1 wherein a radially outward peripheral portion of said radially extending flange is clamped between portions of said handle.

3. A device of claim 1 further including an axial bore formed in said second end member for receiving an air supply tube.

4. A device of claim 1 further including a second radially extending flange extending from a lower end of said second end member, said second radially extending flange including a second axial face generally opposed to said first axial face.

5. A device of claim 4 wherein said elastomeric element is also bonded to said second axial face.

6. A device of claim 1 wherein said isolator receives an air tube therethrough.

7. A device of claim 1 wherein said elastomeric element includes an axially extending cored-out portion adjacent to said external peripheral surface which extends past an end of said axially directed section.

8. A device of claim 1 wherein said elastomer member defines at least a portion of a first variable volume chamber.

9. A device of claim 8 further including a second variable volume chamber axially spaced from said first variable volume chamber.

10. A device of claim 9 wherein a diaphragm defines at least a portion of said second variable volume chamber.

11. A device of claim 9 further including a fluid passageway interconnecting said first and second variable volume chambers.

12. A device of claim 11 wherein said fluid passageway is spiral shaped.

13. A device of claim 1 further comprising:

(a) first and second variable volume chamber associated with said device;

(b) said elastomeric element defining at least a portion of said first variable volume chamber;

(c) a further elastomeric element defining at least a portion of said second variable volume chamber;

(d) a fluid passageway connecting said first and second variable volume chambers; and (e) a fluid contained within, and substantially filling, said first and second variable volume chambers and said fluid passageway;

whereby vibrations of said tool body cause said fluid to flow within said fluid passageway between said first variable volume fluid chamber and said second variable volume fluid chamber which reduce the vibration transmitted to said tool handle.

14. A hand-held vibrating device, comprising:

(a) a tool handle graspable by a user, (b) a tool body axially moveable relative to said tool handle, said tool body adapted to receive a tool, and (c) a vibration isolator attached between said tool handle and said tool body, said isolator including:

(i) a first end member including an radially extending flange attached to said tool handle, (ii) a second end member attached to said tool body, (iii) an elastomeric element in between said first and second members, said elastomeric element being axially compressible, receiving an air tube therethrough, and defining at least a portion of a first variable volume chamber, (iv) a second flexible element axially spaced from said elastomeric element and defining at least a portion of a second variable volume chamber;

(v) a fluid passageway connecting said first and second variable volume chambers; and (vi) a fluid contained within, and substantially filling, said first and second variable volume chambers and said fluid passageway;

whereby vibrations of said tool body cause said fluid to flow within said fluid passageway thereby further reducing the vibration transmitted to said tool handle.

15. A device of claim 14 wherein said second flexible element includes a diaphragm.

16. A device of claim 14 wherein said fluid passageway is helical shaped.

17. A device of claim 14 wherein an air supply tube passes through at least one of said first and second variable volume fluid chambers.

18. A device of claim 14 wherein said elastomeric element comprises a flexible annular element.

19. A device of claim 14 wherein parameters of said passageway are tuned to provide a spring rate which softens at an operating frequency of said hand-held vibrating device.

20. A hand-held vibrating device for reducing the mechanical vibration imparted to the user, comprising:

(a) a tool handle gripable by a user, (b) a tool body moveable relative to said tool handle, said tool body adapted to receive a tool, and (c) a vibration isolator attached between said tool handle and said tool body, said isolator including:

(i) first end member attached to said handle, said first member including a first radially extending flange including a first axial face;

(ii) a second end member attached to said tool body, said second end member including an axially directed section extending towards said first axial face of said first end member and including an external peripheral surface and a radially extending flange having a second axial face; and (iii) an elastomeric element bonded to said first axial face of said radially extending flange and to said external peripheral surface and said second axial face of said second end member, said elastomer element receiving an air supply tube therethrough.

21. A fluid and elastomer vibration isolator for use between a handle to be grasped by a user and a tool body in a hand-held vibrating device, comprising:

(a) a first and second variable volume chambers, (b) a flexible annular element flexibly attached between said tool body and said handle for transferring axial loads applied between the handle and said tool body, said flexible annular element defining a wall portion of said first variable volume chamber;

(c) a diaphragm defining a wall portion of said second variable volume chamber;

(d) a helical fluid passageway communicating between said first and second variable volume chambers, said passageway being tuned to provide a spring rate which softens at an operating frequency of said hand-held vibrating device; and (e) a fluid contained within, and substantially filling, said first and second variable volume chambers and said passageway.

* * * * *